US005477765A

United States Patent [19]

Dietzman

[11] Patent Number: 5,477,765

[45] Date of Patent: Dec. 26, 1995

[54] VIBRATO UNIT FOR A GUITAR

[76] Inventor: William C. Dietzman, 5845 W. Morten Ave., Glendale, Ariz. 85301

[21] Appl. No.: 217,604

[22] Filed: Mar. 24, 1994

[51] Int. Cl.[6] ..... G10D 3/00

[52] U.S. Cl. ..... 84/313

[58] Field of Search ..... 84/297 R, 312 R, 84/313

[56] References Cited

U.S. PATENT DOCUMENTS

| | | | |
|---|---|---|---|
| 4,638,711 | 1/1987 | Stroh | 84/313 |
| 4,763,555 | 8/1988 | Minakuchi et al. | 84/313 |
| 4,782,732 | 11/1988 | Kato et al. | 84/313 |
| 4,944,208 | 7/1990 | Kusek | 84/313 |
| 5,083,492 | 1/1992 | Gorr | 84/313 |
| 5,194,679 | 3/1993 | Cohen | 84/313 |

*Primary Examiner*—Russell E. Adams

*Assistant Examiner*—Eddie C. Lee

*Attorney, Agent, or Firm*—Parsons & Associates; Don J. Flickinger; Robert A. Parsons

[57] ABSTRACT

A vibrato unit including a base plate constructed to fit on a guitar face, a mounting plate pivotally attached to the base plate, and a plurality of saddle mounts, each pivotally attached to the mounting plate. The vibrato unit also includes a plurality of springs, where each spring is affixed between a saddle mount and the base plate and biasing the saddle mount into the normal position. A plurality of vibrato track sections which provides a substantially continuous track along the vibrato unit are included, where one section is mounted on a common vibrato track mount, which is affixed to the mounting plate, and the rest are each mounted on one of the plurality of saddle mounts. Also, the vibrato unit includes a vibrato arm having a movable block attached to one end thereof for movement along the continuous track and when the arm is manipulated the mounting plate and/or the saddle mounts are moved to the vibrato position.

23 Claims, 4 Drawing Sheets

VIBRATO UNIT FOR A GUITAR

BACKGROUND OF THE INVENTION

1. Field of the Invention

This invention relates to guitars.

More particularly the present invention relates to the playing of guitars.

In a further and more specific aspect, the instant invention concerns a vibrato method of playing guitars.

2. Prior Art

Guitars create sound by the movement of the strings which are attached to the guitar. Guitar strings vibrate producing sound waves. These waves sound different depending on their frequency. The frequency of the wave, how high or low it sounds, is called the pitch. The pitch of a note produced by the guitar string depends on the tension placed on the string. This tension is set by tuning the guitar. Tightening the string raises the pitch and loosening the string lowers the pitch. The pitch of the note can also be changed by shortening the string. When playing a guitar the musician shortens the string by holding it against a fret or a fingerboard on the neck of the guitar.

One of the simplest methods of playing the guitar is by holding a group of strings against the fret or fingerboard with the left hand which is called a chord, while strumming across the strings with the right hand. As the musician becomes experienced more complex techniques are used. These techniques are generally used to add expression and feeling to the music being played. Some of these techniques include hammering, slides, string bending, and vibrato.

Vibrato puts a slight waver into a note by making a rapid and slight variation in the pitch. The vibrato method, generally, has the musician moving a finger of the left hand across the string in a rocking motion. Unfortunately, it takes tremendous expertise to get a sustained, regular and accurate pitch variation by this method. In most cases, only one string at a time may be manipulated and the technique can be very hard on the finger.

A device was developed to produce the desired effect, while making the vibrato sound much easier to produce consistently. Many musicians call this device, incorrectly, a tremolo arm. A better name is a vibrato unit. The vibrato unit may deliver a rapid and regular variation in the pitch of the note. The device, generally, replaces the bridge and tailpiece of the guitar and the strings are attached directly to the unit. When playing normally a set of springs hold the unit in position so regular string tension is maintained. When the device is operated by manipulating an arm on the vibrato unit, the string tension changes along with the pitch of the note. When the arm is released the springs force the unit back into the normal position and the strings should return to their original tension.

When many of the prior art devices move back into the normal position the string tension often does not remain exactly the same losing the tuning of the strings. These tuning problems often arise when using a vibrato unit because the device is not balanced correctly. If the balance of the unit is off it could cause more tension on some strings while lessening the tension on others. If any of the springs holding the device happen to break, it could cause increased strain on the rest of the springs and could cause the unit to be imbalanced. Also, if a string was to break it could cause the same imbalancement problem resulting in the rest of the strings becoming detuned. Typically, these devices manipulate all the strings at one time, changing the pitch of all the strings. Generally these devices can not be used on individual strings. These units, also can be difficult to attach and balance, requiring expert skill. It would be highly advantageous, therefore, to remedy the foregoing and other deficiencies inherent in the prior art.

Accordingly, it is an object of the present invention to provide a vibrato unit where the strings stay in tune after it is operated.

Another object of the invention is the provision of a vibrato unit which is stationary and secure while not being operated.

And another object of the invention is to provide a vibrato unit with improved energy transfer to the guitar and improved sound dynamics to the pick-ups.

Still another object of this invention is the provision of a vibrato unit which allows the guitarist to change bridge materials.

Yet another object of the invention is to provide a vibrato unit with the ability to fit on any guitar, with few or no changes to the guitar.

Yet still another object of the immediate invention is the provision of a vibrato unit with improved spring location and design.

And a further object of the invention is to provide a vibrato unit with the ability to manipulate any one string or all the strings at a time.

Still a further object of the invention is the provision of a vibrato unit which is easy to use.

And still another object of the invention is to provide a vibrato unit where a note or notes can be sustained for an extended length of time.

Yet still a further object of the invention is the provision of a vibrato unit which allows all the rest of the strings to stay in tune when one or more strings break.

SUMMARY OF THE INVENTION

Briefly, to achieve the desired objects of the invention in accordance with the preferred embodiments thereof, provided is a vibrato unit comprising a base plate constructed to fit on a guitar face, a mounting plate pivotally attached to the base plate for movement between a normal and a vibrato position, a plurality of saddle mounts each pivotally attached to the mounting plate for movement between a normal and a vibrato position, a plurality of springs one each affixed between each saddle mount and the base plate and biasing the saddle mount into the normal position, a common vibrato track mount affixed to the mounting plate, a plurality of vibrato track sections one each mounted on the common vibrato track mount and the plurality of saddle mounts to provide a substantially continuous track, and a vibrato arm having a movable block attached to one end thereof for movement along the track, where when said block is positioned in the track section affixed to the common vibrato track mount and the arm is manipulated the mounting plate and all the saddle mounts are moved to the vibrato position and when said block is positioned in a track section affixed to a specific saddle mount and the arm is manipulated only the specific saddle mount is moved into the vibrato position.

More specifically, in a first embodiment of the invention, a vibrato unit is provided wherein the base plate is L-shaped with an integrally formed arm at one end and the arm is positioned in a groove in the guitar face for added stability.

In a further embodiment of the invention, a method of attaching the vibrato unit is detailed comprising the steps of providing a guitar with a face and a plurality of strings, providing a vibrato unit in accordance with the instant invention, affixing a base plate of the vibrato unit to the face of the guitar by a plurality of bolts, and inserting the plurality of guitar strings one each into a plurality of saddle mounts.

BRIEF DESCRIPTION OF THE DRAWINGS

The foregoing and further and more specific objects and advantages of the instant invention will become readily apparent to those skilled in the art from the following detailed description of the preferred embodiment thereof taken in conjunction with the drawings in which.

DETAILED DESCRIPTION OF THE PREFERRED EMBODIMENT

Figure 1:
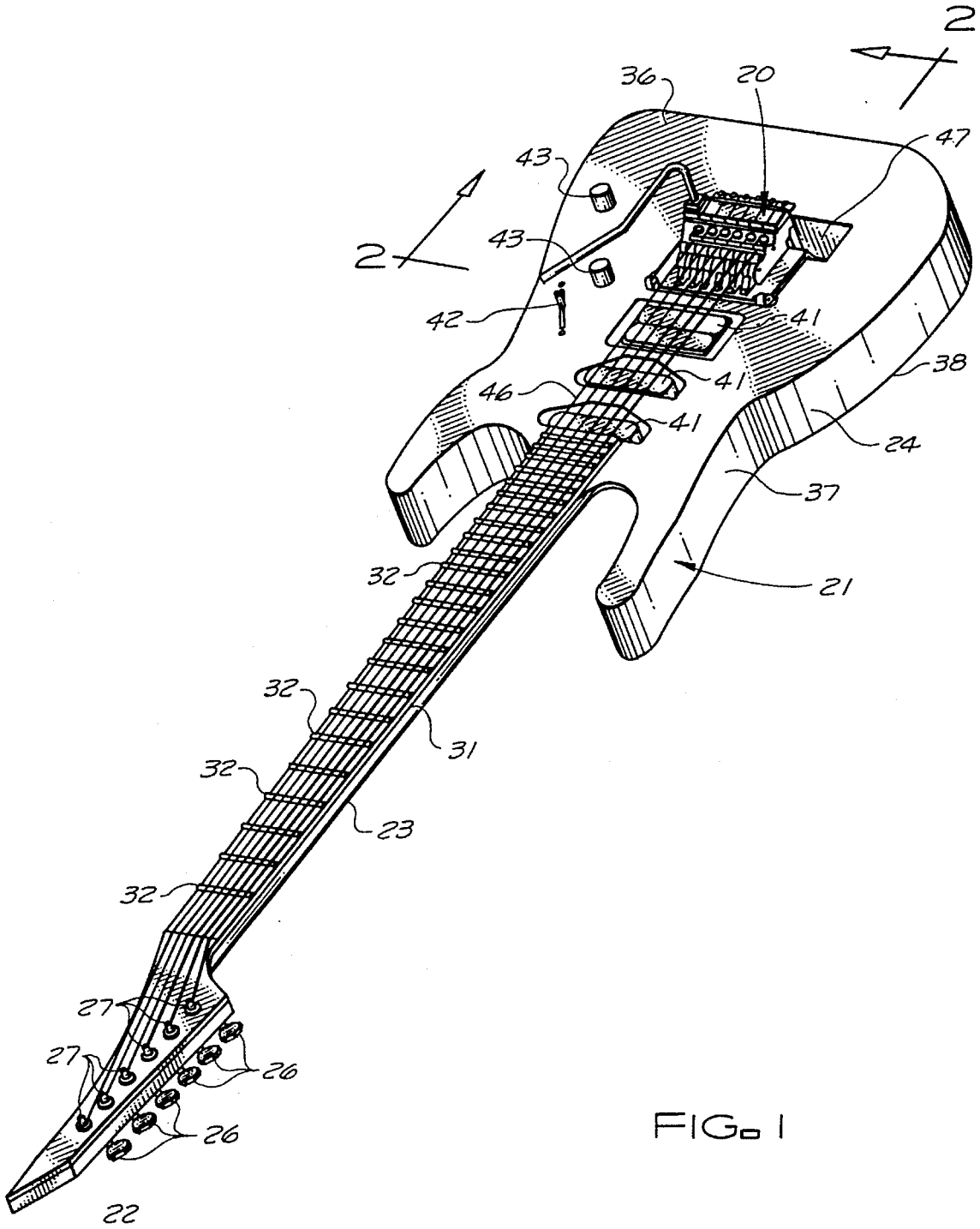
FIG. 1 is perspective view of a guitar including a vibrato unit in accordance with the instant invention.

Turning now to the drawings in which like reference characters indicate corresponding elements throughout the several views, attention is first directed to FIG. 1 which illustrates an improved vibrato unit 20 for a guitar 21, in accordance with the instant invention. In this embodiment guitar 21 is an electric guitar, but it should be understood that any guitar may be used. Guitar 21 has a headstock 22 attached by a neck 23 to a solid body 24. Headstock 22 has a plurality of tuning heads 26, with a capstan 27 attached to each tuning head 26. It should be understood that though guitar 21 is illustrated as having six tuning heads 26, any 14 number may be used. Neck 23 includes a fingerboard 31 with a plurality of frets 32 attached adjacent a top side thereof. Solid body 24 is comprised of a face 36, sides 37, and a back 38. Face 36 of guitar 21 has affixed adjacent the top edge thereof pickups 41, toggle switch 42, volume and tone controls 43 and vibrato unit 20. A plurality of strings 46 are attached at one end to headstock 22 each by a capstan 27, traversing fingerboard 31 of neck 23 and pickups 41 of solid body 24 to be attached at the other end to vibrato unit 20.

Figure 2:
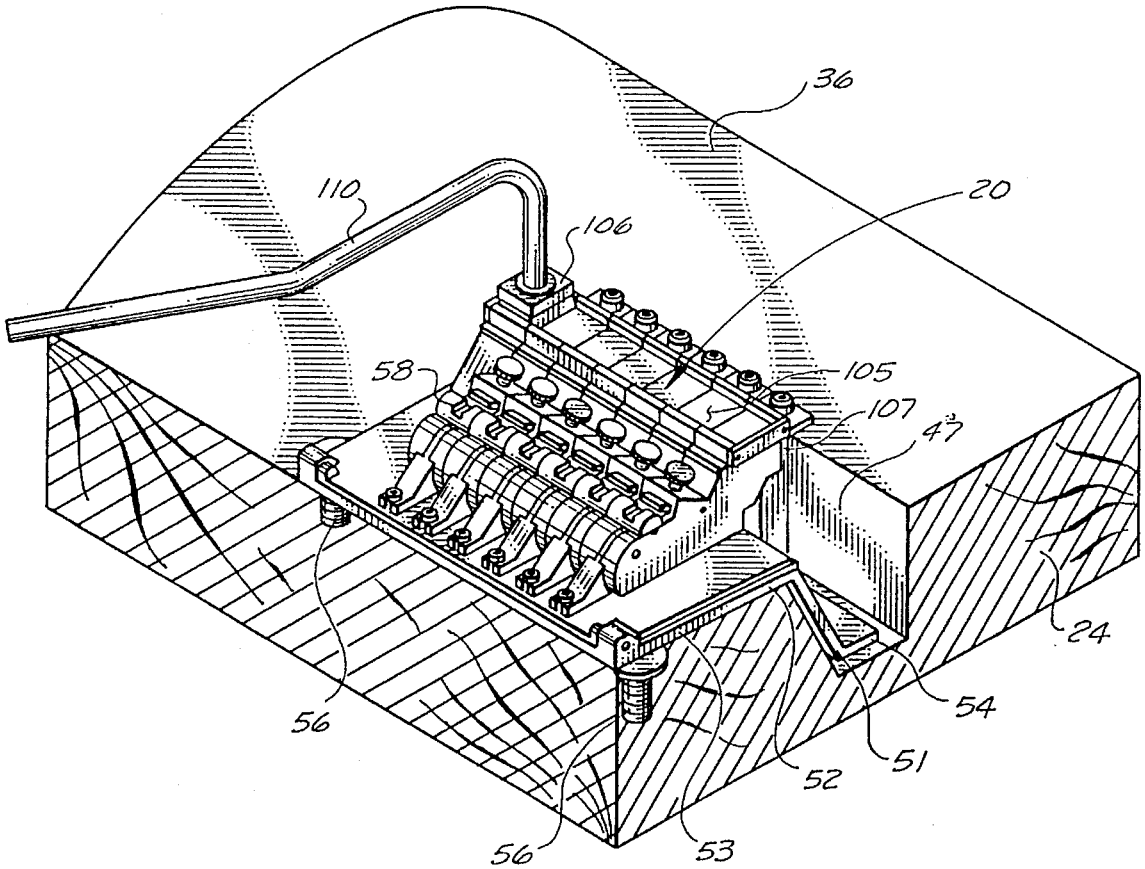
FIG. 2 is an enlarged perspective view as seen from line 2—2 of FIG. 1.

Referring specifically to FIG. 2, the manner of mounting vibrato unit 20 on face 36 of solid body 24 is illustrated. A groove 47 is formed into solid body 24 through face 36. Groove 47 is sufficiently deep to receive an arm 51 of an L-shaped base plate 52 with a flat base portion 53 lying on face 36. Further, arm 51 has a flat portion 54 positioned on the bottom surface of groove 47. A plurality of screws 56 (as seen with specific reference to FIG. 4) are prethreaded (using threaded holes, anchors, or the like) into solid body 24 through face 36. Base plate 52 is then set into the correct position and held in place by affixing it to the plurality of screws 56 by some convenient means such as nuts, set screws, or the like. It should be noted that the unique conformation of base plate 52, along with the plurality of screws 56, hold base plate fixedly in position and prevent any horizontal movement. The remainder of vibrato unit 20 is pivotally attached to base plate 52 which is affixed to guitar 21.

Figure 3:
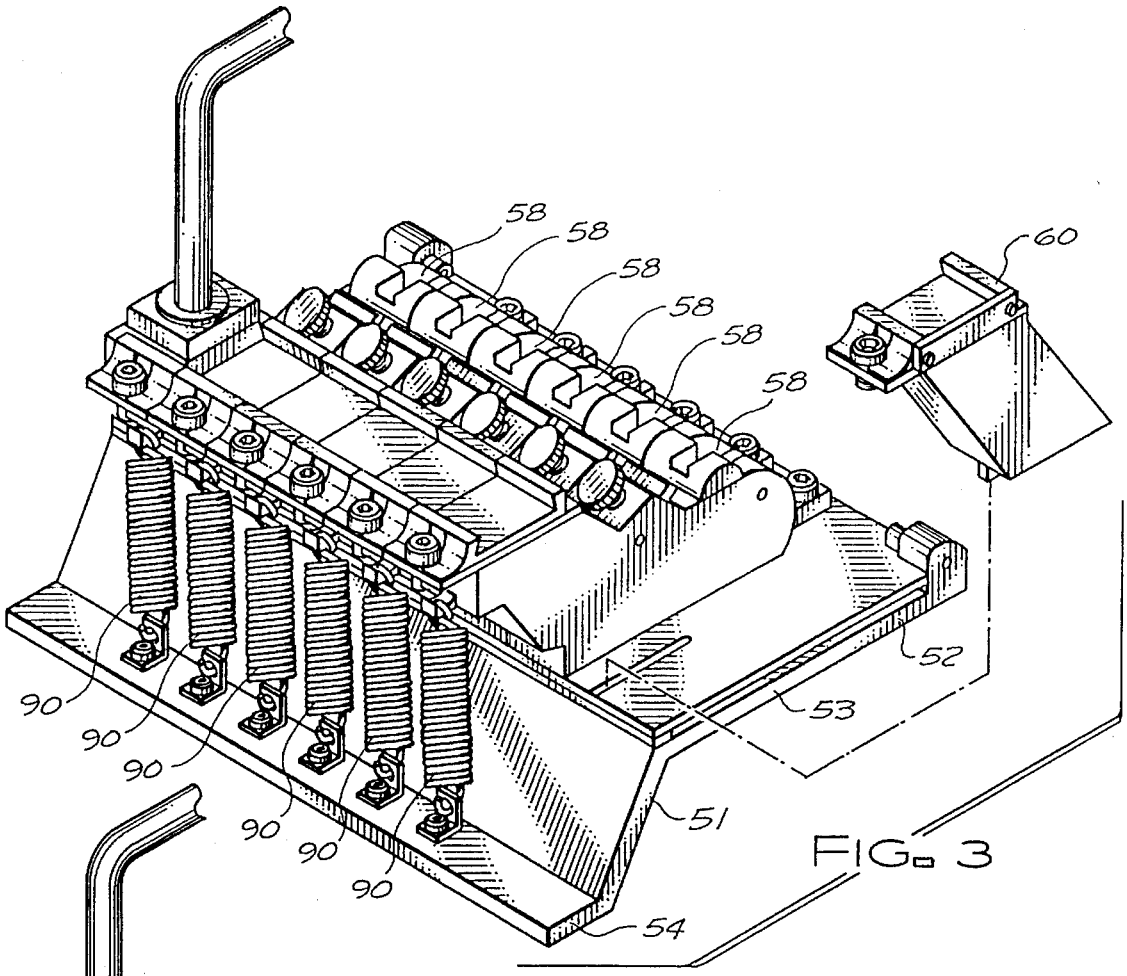
FIG. 3 is an enlarged view of a portion of FIG. 1.

An enlarged reverse view of vibrato unit 20 is illustrated in FIG. 3 to aid in the clarity of understanding. From an inspection of FIGS. 2 and 3 it can be seen that vibrato unit 20 includes a plurality of saddle mounts 58 (six in this embodiment, one for each string 46) and a common vibrato track mount 60. Because each of saddle mounts 58 are similar, only one will discussed in detail in regards to FIG. 4.

Figure 4:
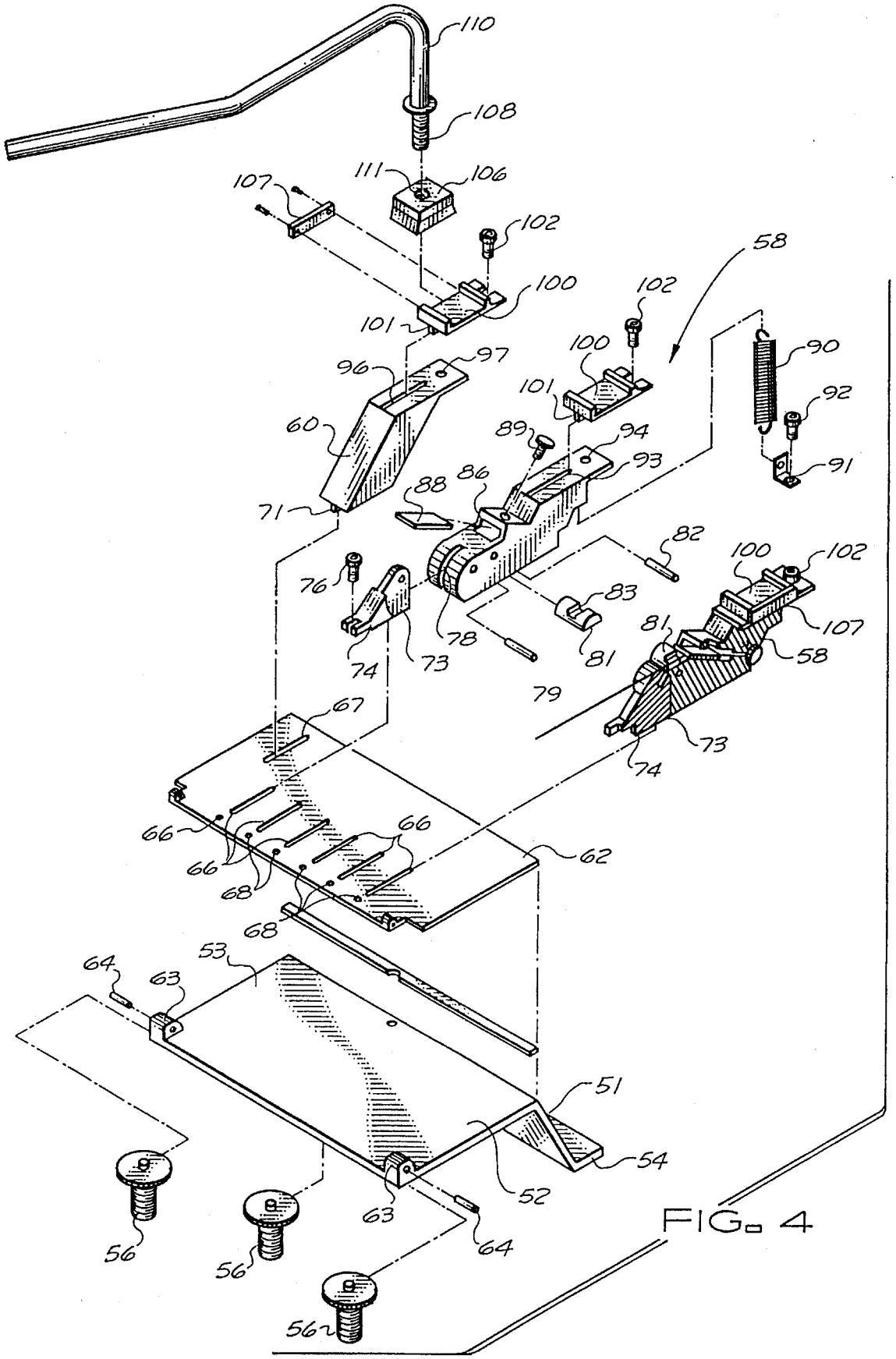
FIG. 4 is an exploded perspective view of a vibrato unit.

Referring to FIG. 4, a mounting plate 62 is pivotally affixed to base plate 52 at each of a pair of pivot points 63 by a pivot pin 64 for movement between a normal and a vibrato position. Mounting plate 62 has a plurality of slots 66 (six in this embodiment, one for each saddle mount 58) adjacent the pivot edge and a slot 67 adjacent the opposite edge (for common vibrato track mount 60) therethrough. Each slot 66 has a corresponding screw hole 68 formed through mounting plate 62. Common vibrato track mount 60 has a downwardly extending tab 71 integrally formed on the bottom thereof which is inserted into slot 67 of mounting plate 62 and is held in place by welding, set screw, or the like. Saddle mount 58 is attached to mounting plate 62 by a mounting pivot 73. Mounting pivot 73 has a downwardly extending tab 74 integrally formed on the bottom thereof which is inserted into slot 66 and held in place by a screw 76 threaded through screw hole 68. Tab 74 and screw 76 hold mounting pivot 73 fixedly in position and prevent any horizontal movement. Mounting pivot 73 is inserted into a slit 78 in the front edge of saddle mount 58 and is held in place by a pivot pin 79 allowing for pivotally movement between a normal and a vibrato position.

A saddle 81 is affixed adjacent the front top edge of saddle mount 58 by a pin 82. Saddle 81 has a notch 83 therein to accommodate string 46. Saddle 81 may be constructed of brass, stainless steel, bone plastic or the like and acts as part of a bridge for guitar 21. Saddle mount 58 has a string opening 86, behind saddle 81, of sufficient size to accommodate string 46 and a tailpiece 88. Tailpiece 88 is inserted into string opening 86 clamping one end of inserted string 46 between string opening 86 and itself. Tailpiece 88 is held in the correct position in string opening 86 by a screw 89 which can be loosened or tightened to allow for vertical movement by tailpiece 88.

A spring 90 is affixed between saddle mount 58 and base plate 52 biasing saddle mount 58 into the normal position. Spring 90 is affixed to base plate 52 by an L-bracket 91 with a screw 92. In this embodiment, spring 90 is a spiral spring, but it should be understood that a leaf spring 90A may also be used, as illustrated in FIG. 5.

Referring again to FIG. 4, saddle mount 58 has a slot 93 in the top, behind string opening 86, with a corresponding screw hole 94 and common vibrato track mount 60 has a slot 96 in the top with a corresponding screw hole 97. Mounted on saddle mounts 58 and common vibrato track mount 60 are a plurality of vibrato track sections 100 (one for each saddle mount 58 and one for common vibrato track mount 60). Each of the plurality of vibrato track sections 100 are similar and have a downwardly extending tab 101 integrally formed on the bottom thereof. One of the plurality of vibrato track sections 100 is mounted on saddle mount 58 by placing tab 101 into slot 93 of saddle mount 58, with slot 93 being of sufficient size to receive tab 101. Vibrato track section 100 is held fixedly in place on saddle mount 58 by a screw 102 threaded into screw hole 94. One of the plurality of vibrato track sections 100 is also mounted on common vibrato track mount 60 by placing tab 101 into slot 96, with slot 96 being of sufficient size to receive tab 101 and vibrato track section 100 is held fixedly in place on common vibrato track mount 60 by a screw 102 threaded into screw hole 97. The plurality of vibrato track sections 100 provide a substantially continuous track 105 (see FIG. 2).

Track 105 is of sufficient proportions to receive a movable block 106. In this embodiment, both movable block 106 and track 105 are dovetailed so that movable block 106 is retained in but allowed to move freely along track 105, but it should be understood that any method such as grooves, T-shaped rails or the like may be used in place of the dovetails. Track 105 has a pair of stops 107 affixed at opposite ends thereof to keep moveable block 106 from moving past the end of track 105. A threaded end 108 of a vibrato arm 110 is received by a threaded hole 111 through movable block 106 attaching vibrato arm 110 to movable block 106. When movable block 106 is positioned in vibrato track section 100 mounted on common vibrato track mount 60 and vibrato arm 110 is manipulated, mounting plate 62 and all of the plurality of saddle mounts 58 are moved from the normal position to the vibrato position. When movable block 106 is positioned in one of the plurality of vibrato track section 100 mounted on one of the plurality of saddle mounts 58 and vibrato arm 110 is manipulated, only the specific saddle mount 58 containing the movable block 106 is moved from the normal position to the vibrato position.

Figure 5:
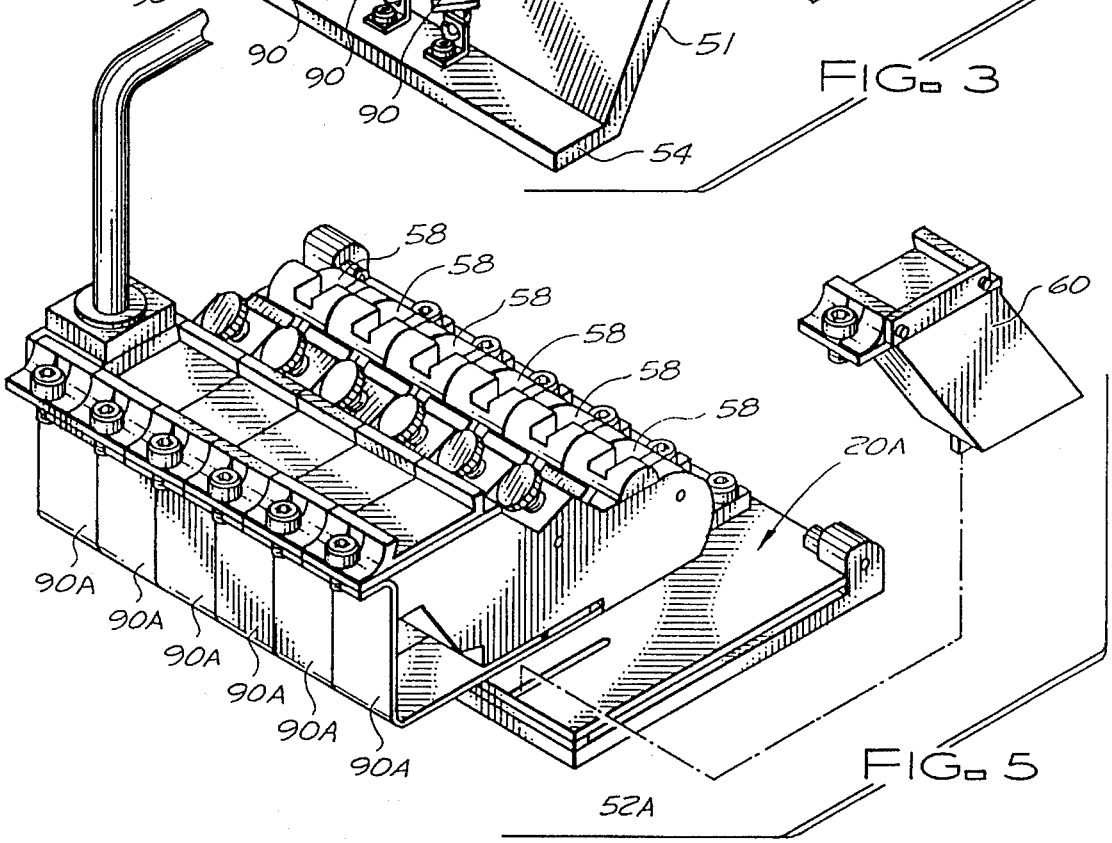
FIG. 5 is a perspective view of a different embodiment of a vibrato unit.

Referring to FIG. 5, another embodiment of vibrato unit 20A is illustrated. In this embodiment base plate 52A does not have arm 51 requiring groove 47 in guitar 21. Face plate 52a is mounted on face 36 of solid body 24 by the plurality of screws 56 just as in the previous embodiment. The remainder of vibrato unit 20A is pivotally attached to base plate 52A in the same manner as previously described for vibrato unit 20.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A vibrato unit comprising:

a base plate constructed to fit on a guitar face;

a mounting plate pivotally attached to the base plate for movement between a normal and a vibrato position;

a plurality of saddle mounts, each pivotally attached to the mounting plate for movement between a normal and a vibrato position;

a plurality of springs, one each affixed between each saddle mount and the base plate and biasing each saddle mount into the normal position;

a common vibrato track mount affixed to the mounting plate;

a plurality of vibrato track sections, one each mounted on the common vibrato track mount and the plurality of saddle mounts to provide a continuous track; and a vibrato arm having a movable block attached to one end thereof for movement along the continuous track, where when said block is positioned in the track section affixed to the common vibrato track mount and the arm is manipulated, the mounting plate and all the saddle mounts are moved to the vibrato position, and when said block is positioned in a track section affixed to a specific saddle mount and the arm is manipulated, only the specific saddle mount is moved into the vibrato position.

2. A vibrato unit as claimed in claim 1 wherein the springs can be one of a leaf and a spiral.

3. A vibrato unit as claimed in claim 1 wherein each of the plurality of saddle mounts includes a saddle which accommodates a guitar string.

4. A vibrato unit as claimed in claim 3 wherein the saddle is constructed of one of brass, stainless steel, bone, and plastic.

5. A vibrato unit as claimed in claim 1 wherein each of the plurality of saddle mounts includes a tailpiece for holding a guitar string.

6. A vibrato unit as claimed in claim 1 wherein the base plate is L-shaped with an integrally formed arm at one end of the base plate and the arm is positioned in a groove in the guitar face for added stability.

7. A vibrato unit as claimed in claim 1 wherein the vibrato track section mounted on the common vibrato track mount and the vibrato track section mounted on a last saddle mount, each have a stop affixed to an opposite end thereof to keep the vibrato arm from moving past the opposite ends.

8. A vibrato unit as claimed in claim 1 wherein the block attached to the end of the vibrato arm is dovetailed.

9. A vibrato unit as claimed in claim 8 wherein the track is dovetailed to receive the block.

10. A vibrato unit as claimed in claim 1 wherein the base plate is affixed to the guitar face by a plurality of bolts.

11. A method of attaching a vibrato unit comprising the steps of:

providing a guitar with a face and a plurality of strings;

providing a vibrato unit comprising a base plate constructed to fit on the guitar face, a mounting plate pivotally attached to the base plate for movement between a normal and a vibrato position, a plurality of saddle mounts each pivotally attached to the mounting plate for movement between a normal and a vibrato position, a plurality of springs one each affixed between each saddle mount and the base plate and biasing each saddle mount into the normal position, a common vibrato track mount affixed to the mounting plate, a plurality of vibrato track sections one each mounted on the common vibrato track mount and the plurality of saddle mounts to provide a continuous track, and a vibrato arm having a movable block attached to one end thereof for movement along the continuous track, where when said block is positioned in the track section affixed to the common vibrato track mount and the arm is manipulated, the mounting plate and all the saddle mounts are moved to the vibrato position, and when said block is positioned in a track section affixed to a specific saddle mount and the arm is manipulated, only the specific saddle mount is moved into the vibrato position;

affixing the base plate to the face of the guitar by a plurality of bolts; and inserting a plurality of guitar strings, one each into the plurality of saddle mounts.

12. A method as claimed in claim 11 wherein the step of providing a vibrato unit includes providing a vibrato unit including springs selected from one of a leaf and a spiral.

13. A method as claimed in claim 11 wherein the step of providing a vibrato unit includes providing a vibrato unit wherein each of the plurality of saddle mounts has a saddle to accommodate one of the plurality of guitar strings.

14. A method as claimed in claim 13 wherein the step of providing a vibrato unit includes providing a vibrato unit including the saddle being constructed of one of brass, stainless steel, bone, and plastic.

15. A method as claimed in claim 11 wherein the step of providing a vibrato unit includes providing a vibrato unit wherein each of the plurality of saddle mounts has a tailpiece for holding a guitar string.

16. A method as claimed in claim 15 wherein the step of inserting a plurality of guitar strings includes inserting the string under the tailpiece.

17. A method as claimed in claim 11 wherein the step of providing a vibrato unit includes providing a vibrato unit wherein the base plate is L-shaped with an integrally formed arm at one end thereof.

18. A method as claimed in claim 17 wherein the step of affixing the base plate includes making a groove in the guitar face.

19. A method as claimed in claim 18 wherein the step of affixing the base plate to the face of the guitar includes the arm being positioned in a groove in the guitar face for added stability.

20. A method as claimed in claim 11 wherein the step of providing a vibrato unit includes providing a vibrato unit wherein the vibrato track section mounted on the common vibrato track mount and the vibrato track section mounted on a last saddle mount, each have a stop affixed to an opposite end thereof to keep the vibrato arm from moving past the opposite ends.

21. A method as claimed in claim 11 wherein the step of providing a vibrato unit includes providing a vibrato unit wherein the block attached to the end of the vibrato arm is dovetailed.

22. A method as claimed in claim 21 wherein the step of providing a vibrato unit includes providing a vibrato unit including the track being generally dovetailed to receive the block.

23. A method as claimed in claim 11 wherein the step of affixing the base plate to the face of the guitar includes drilling a plurality of holes in the guitar face for receiving the plurality of bolts.

* * * * *